US012690734B2

(12) United States Patent
Lee et al.

(10) Patent No.: US 12,690,734 B2
(45) Date of Patent: Jul. 28, 2026

(54) CLEANER HEAD AND CLEANER INCLUDING THE SAME

(71) Applicant: SAMSUNG ELECTRONICS CO., LTD., Suwon-si (KR)

(72) Inventors: Byoungin Lee, Suwon-si (KR); Taegwang Kim, Suwon-si (KR); Jiwon Choi, Suwon-si (KR); Dongwoo Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 262 days.

(21) Appl. No.: 17/977,826

(22) Filed: Oct. 31, 2022

(65) Prior Publication Data

US 2023/0157496 A1 May 25, 2023

Related U.S. Application Data

(63) Continuation of application No. PCT/KR2022/016296, filed on Oct. 24, 2022.

(30) Foreign Application Priority Data

Nov. 19, 2021 (KR) ..... 10-2021-0160243

(51) Int. Cl.
*A47L 9/04* (2006.01)

(52) U.S. Cl.
CPC ..... *A47L 9/0411* (2013.01); *A47L 9/0455* (2013.01); *A47L 9/0477* (2013.01)

(58) Field of Classification Search
CPC .... A47L 9/0081; A47L 9/0411; A47L 9/0438; A47L 9/04; A47L 9/0477; A47L 9/0455; A47L 5/30; A47L 9/2847; A47L 9/283
See application file for complete search history.

(56) References Cited

U.S. PATENT DOCUMENTS 6,437,465 B1 8/2002 Nishimura et al.
8,898,858 B2 12/2014 Dyson et al.
(Continued)

FOREIGN PATENT DOCUMENTS

CN 103829882 A 6/2014
EP 3900595 A1 * 10/2021 ..... A47L 9/0477
(Continued)

OTHER PUBLICATIONS

Translation of KR20200058364A (Year: 2024).*
(Continued)

*Primary Examiner* — Monica S Carter
*Assistant Examiner* — Sarah Akyaa Fordjour
(74) *Attorney, Agent, or Firm* — STAAS & HALSEY LLP

(57) ABSTRACT

A cleaner head having a first support portion and a second support portion of a brush case rotatably supporting a brush drum, includes a base portion forming an end of the brush case, a bearing mounting portion protruding toward the brush chamber from the base portion to support a bearing coupled to one end portion of the brush drum and providing an insertion space into which an end portion of a driving housing is insertable, and a driving mounting portion arranged to be separated from the bearing mounting portion and supporting an end portion of the driving housing inserted into the insertion space.

17 Claims, 10 Drawing Sheets

(56) References Cited

U.S. PATENT DOCUMENTS

| | | | | |
|---|---|---|---|---|
| 9,949,605 | B2 | 4/2018 | Isley et al. | |
| 10,555,650 | B2 | 2/2020 | Genn et al. | |
| 10,905,302 | B2 | 2/2021 | Moon et al. | |
| 2003/0188397 | A1* | 10/2003 | Syverson | A47L 9/0411 15/389 |
| 2011/0303239 | A1 | 12/2011 | Harrison et al. | |
| 2014/0143978 | A1 | 5/2014 | Li et al. | |
| 2015/0265117 | A1* | 9/2015 | Genn | A47L 9/0455 15/363 |
| 2020/0397203 | A1 | 12/2020 | Yang et al. | |
| 2021/0015327 | A1 | 1/2021 | Taylor et al. | |
| 2021/0212535 | A1 | 7/2021 | Kegg et al. | |

FOREIGN PATENT DOCUMENTS

| | | | |
|---|---|---|---|
| JP | 2001000371 A | * | 1/2001 |
| JP | 5052686 | | 10/2012 |
| JP | 2002-238815 | | 8/2022 |
| KR | 10-0384980 | | 6/2003 |
| KR | 10-1662045 | | 10/2016 |
| KR | 10-1792504 | | 11/2017 |
| KR | 10-1823452 | | 1/2018 |
| KR | 10-1836299 | | 3/2018 |
| KR | 10-1911294 | | 10/2018 |
| KR | 20200058364 A | * | 5/2020 |
| KR | 10-2312151 | | 10/2021 |
| WO | WO 2019/186089 A1 | | 10/2019 |

OTHER PUBLICATIONS

Translation of EP_3900595_A1_H (Year: 2025).*
Translation of JP_2001000371_A_H (Year: 2025).*
International Search Report dated Feb. 3, 2023 in International Patent Application No. PCT/KR2022/016296 (3 pages).
Extended European Search Report issued Oct. 15, 2024 for European Patent Application No. 22895876.5.
European Office Action dated Nov. 7, 2025 for EP Patent Application No. 22895876.5.

* cited by examiner

CLEANER HEAD AND CLEANER INCLUDING THE SAME

CROSS-REFERENCE TO RELATED APPLICATION(S)

This application is a continuation application, under 35 U.S.C. § 111(a), of International Application No. PCT/KR2022/016296, filed on Oct. 24, 2022, which claims priority to Korean Patent Application No. 10-2021-0160243, filed on Nov. 19, 2021 in the Korean Intellectual Property Office, the disclosure of which is incorporated by reference herein in its entirety.

BACKGROUND

1. Field

Embodiments of the disclosure relate to a cleaner head and a cleaner.

2. Description of Related Art

A cleaner is a home appliance that sucks in air containing foreign substances such as dust, by using a negative (−) pressure generated by a motor assembly mounted inside a main body of the cleaner, and then filters foreign substances from the inside of the main body.

To compensate for the suction power of the cleaner, a brush drum is provided in a cleaner head to repeatedly contact a floor surface. The cleaner head may include a driving assembly having a driving motor for driving the brush drum, in addition to a motor assembly that is a main motor.

Due to a volume of the cleaner head, the driving motor for driving the brush drum may be arranged inside the brush drum. To arrange the driving motor inside the brush drum, the driving assembly includes a driving housing for supporting the driving motor, and the driving housing may be supported by one end portion of the cleaner head.

However, as the driving housing is supported by the one end portion of the cleaner head, i.e., is supported in a cantilever form, the driving housing may be bent or misaligned due to the weight of the driving motor, etc., causing a rotation axis of the brush drum to be misaligned. When the rotation axis of the brush drum is misaligned, noise may be generated in the cleaner head.

SUMMARY

According to an embodiment of the disclosure, a cleaner head may include a brush drum.

The cleaner head may include a driving assembly having a driving motor arranged inside the brush drum and configured to transfer rotation power to the brush drum and a driving housing to support the driving motor.

The cleaner head may include brush case having a brush chamber to accommodate the brush drum, the brush case comprising a first support portion and a second support portion to support the brush drum so that the brush drum is rotatable, the first support portion and the second support portion being arranged in a first end portion of the brush drum and a second end portion of the brush drum, respectively, the first end portion and the second end portion being arranged along a rotation axis of the brush drum.

The first support portion may include a base portion forming an end portion of the brush case.

The first support portion may include a bearing mounting portion formed to protrude toward the brush chamber from the base portion to support a bearing coupleable to the first end portion of the brush drum and provide an insertion space into which an end portion of the driving housing is insertable.

The first support portion may include a driving mounting portion arranged to be separated from the bearing mounting portion and support the end portion of the driving housing inserted into the insertion space.

According to an embodiment of the disclosure, a cleaner includes a cleaner head.

The cleaner head may include a brush drum.

The cleaner head may include a driving assembly having a driving motor arranged inside the brush drum and configured to transfer rotation power to the brush drum and a driving house to support the driving motor.

The cleaner head may include a brush case having a brush chamber to accommodate the brush drum, the brush case comprising a first support portion and a second support portion to support the brush drum so that the brush drum is rotatable, the first support portion and the second support portion being arranged in a first end portion of the brush drum and a second end portion of the brush drum, respectively, in the first end portion and the second end portion being arranged along a rotation axis of the brush.

The first support portion may include a base portion forming one end portion of the brush case.

The first support portion may include a bearing mounting portion formed to protrude toward the brush chamber from the base portion to support a bearing coupleable to the first end portion of the brush drum and provide an insertion space into which an end portion of the driving housing is insertable.

The first support portion may include a driving mounting portion arranged to be separated from the bearing mounting portion and support the end portion of the driving housing that is inserted into the insertion space.

BRIEF DESCRIPTION OF DRAWINGS

The above and other aspects, features, and advantages of certain embodiments of the present disclosure will be more apparent from the following description taken in conjunction with the accompanying drawings, in which.

DETAILED DESCRIPTION

Figure 1:
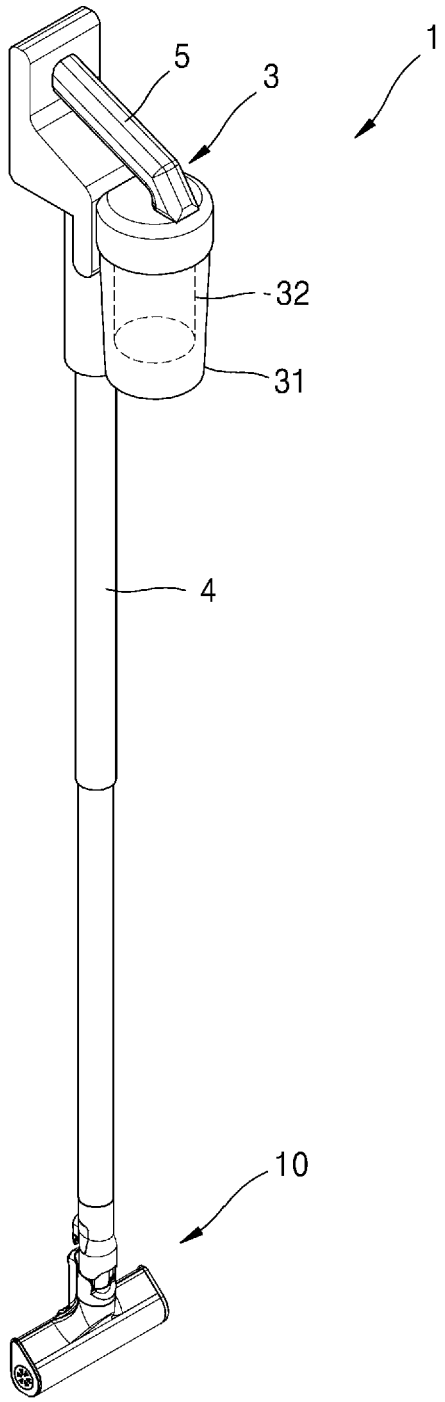
FIG. 1 is a diagram showing a cleaner according to an embodiment of the disclosure.

Throughout the disclosure, the expression "at least one of a, b or c" indicates only a, only b, only c, both a and b, both a and c, both b and c, all of a, b, and c, or variations thereof.

Hereinafter, exemplary embodiments of the disclosure will be described in detail with reference to matters described in the accompanying drawings. The same reference numeral or symbol presented in each drawing represents a part or component that performs substantially the same function.

The terms including "first", "second", etc., may be used to explain various components, but the components are not limited by the terms. These terms may be used to distinguish one element from another element. For example, a first component may be referred to as a second component without departing from the scope of the disclosure, and similarly, the second component may be referred to as the first component. The term "and/or" may include a combination of a plurality of related items or any one of the plurality of related items.

The term used herein is used to describe an embodiment of the disclosure, and is not intended to limit and/or restrict the disclosure. Singular forms include plural forms unless apparently indicated otherwise contextually. Moreover, it should be understood that the term "include", "have", or the like used herein is to indicate the presence of features, numbers, steps, operations, elements, parts, or a combination thereof described in the specifications, and does not preclude the presence or addition of one or more other features, numbers, steps, operations, elements, parts, or a combination thereof. The same reference numeral presented in each drawing represents a member that substantially performs the same function.

Herein, there are provided a cleaner head and a cleaner including the same to prevent the axis of a driving assembly from being misaligned and provide good rotation characteristics of a brush drum.

FIG. 1 is a diagram showing a cleaner 1 according to an embodiment of the disclosure. Referring to FIG. 1, the cleaner 1 according to an embodiment of the disclosure may include a cleaner main body 3 and a cleaner head 10. The cleaner 1 may include a suction pipe 4 that connects the cleaner main body 3 to the cleaner head 10 and a handle portion 5 connected to the cleaner main body 3. The cleaner 1 may be a wireless cleaner, but may be a wired cleaner without being limited thereto.

The cleaner main body 3 may include a dust bin 31 and a driving unit 32 that are provided therein. The dust bin 31 may store dust or garbage on a cleaning surface sucked from the cleaner head 10. The dust bin 31 may be connected to be removable from the cleaner main body 3, and may be separated according to user's convenience.

The driving unit 32 may include a motor assembly (not shown) provided to drive the cleaner 1. The motor assembly may generate suction power inside the cleaner main body 3.

The cleaner head 10 may be provided to suck in foreign substances such as dust present on the cleaning surface while moving in contact with the cleaning surface. The cleaner head 10 may be connected to an end portion of a side of the suction pipe 4.

Figure 2:
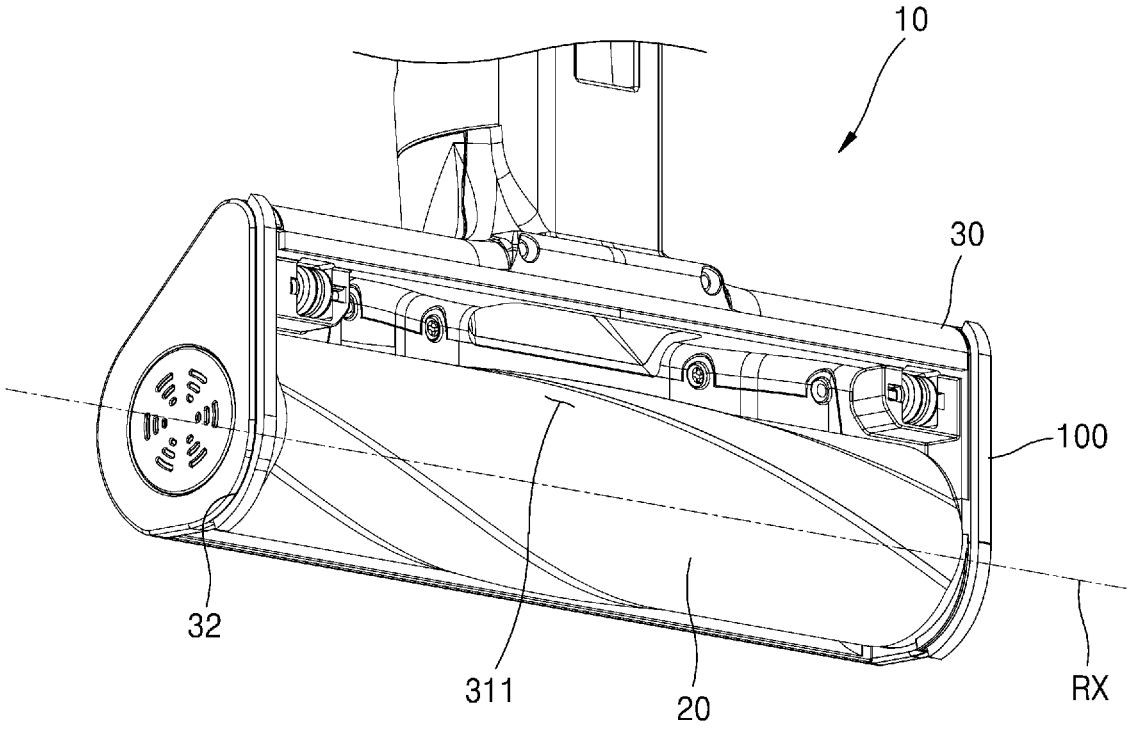
FIG. 2 is an assembled perspective view of a cleaner head according to an embodiment of the disclosure.
Figure 3:
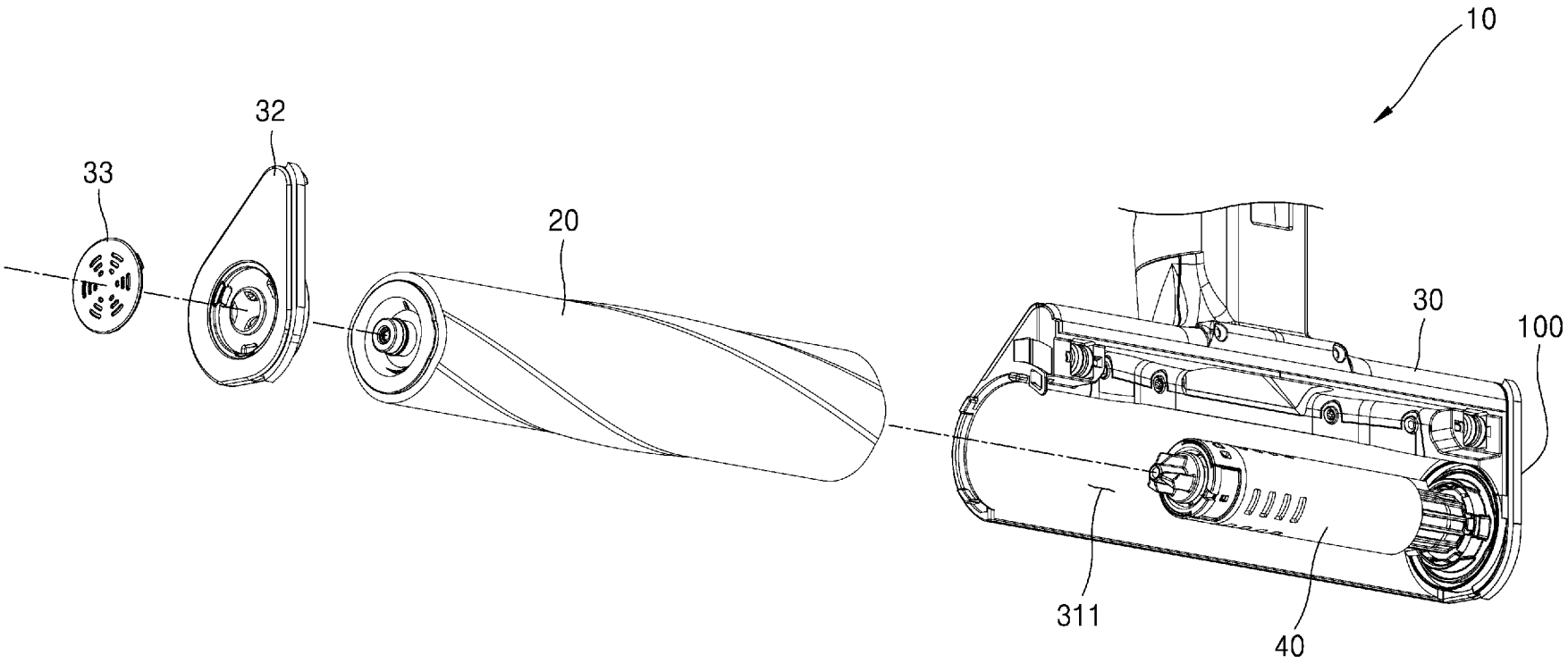
FIG. 3 is an exploded perspective view of a cleaner head according to an embodiment of the disclosure.
Figure 4:
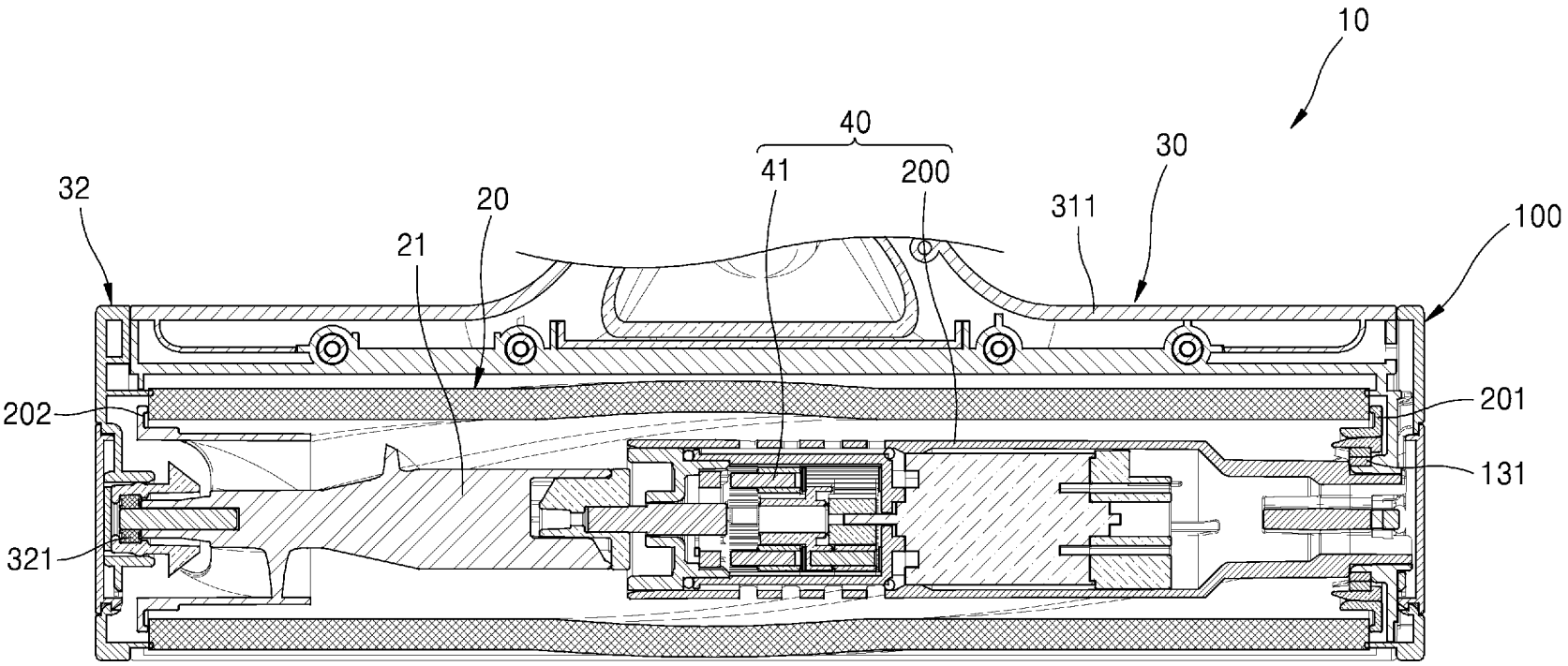
FIG. 4 is a cross-sectional view of the cleaner head of FIG. 2.

FIG. 2 is an assembled perspective view of the cleaner head 10 according to an embodiment of the disclosure, and FIG. 3 is an exploded perspective view of the cleaner head 10 according to an embodiment of the disclosure. FIG. 4 is a cross-sectional view of the cleaner head 10 of FIG. 3. Referring to FIGS. 2 to 4, the cleaner head 10 may include a brush drum 20, a brush case 30, and a driving assembly 40.

The brush drum 20 may rotate around a rotation axis RX and have a drum structure. The brush drum 20 may repeatedly contact the cleaning surface while rotating to separate foreign substances from the cleaning surface.

The brush case 30 may provide a brush chamber 311 for accommodating the brush drum 20. The brush case 30 may include a first support portion 100 and a second support portion 32 that are arranged in both end portions in a direction of the rotation axis RX of the brush drum 20. The first support portion 100 and the second support portion 32 may support the brush drum 20 such that the brush drum 20 rotates. The second support portion 32 may be assembled to be separated from the brush case 30. A cap cover 33 may be assembled to the second support portion 32.

A driving assembly 40 is intended to transfer rotation power to the brush drum 20, and may include a driving motor 41 and a driving housing 200. The drive motor 41 may be arranged inside the brush drum 20 and transfer the rotation power to the brush drum 20. The driving housing 200 may support the driving motor 41 arranged inside the brush drum 20 and may be supported by the first support portion 100. The rotation axis of the driving motor 41 and the rotation axis RX of the brush drum 20 may be arranged concentrically. The first support portion 100 may execute a function of supporting the driving assembly 40, along with a function of supporting one end portion of the brush drum 20.

One end portion 201 of the brush drum 20 may be supported rotatably by a bearing 131 supported by the first support portion 100, and the other end portion 202 thereof may be supported rotatably by a bearing 321 arranged in the second support portion 32. The brush drum 20 may receive driving power of the driving motor 41 arranged therein through a driving input unit 21, and rotate. However, in a structure where the driving motor 41 is arranged inside the brush drum 20, the driving housing 200 supporting the driving motor 41 may be weak to distortion due to the weight of the driving motor 41, etc.

Figure 5:
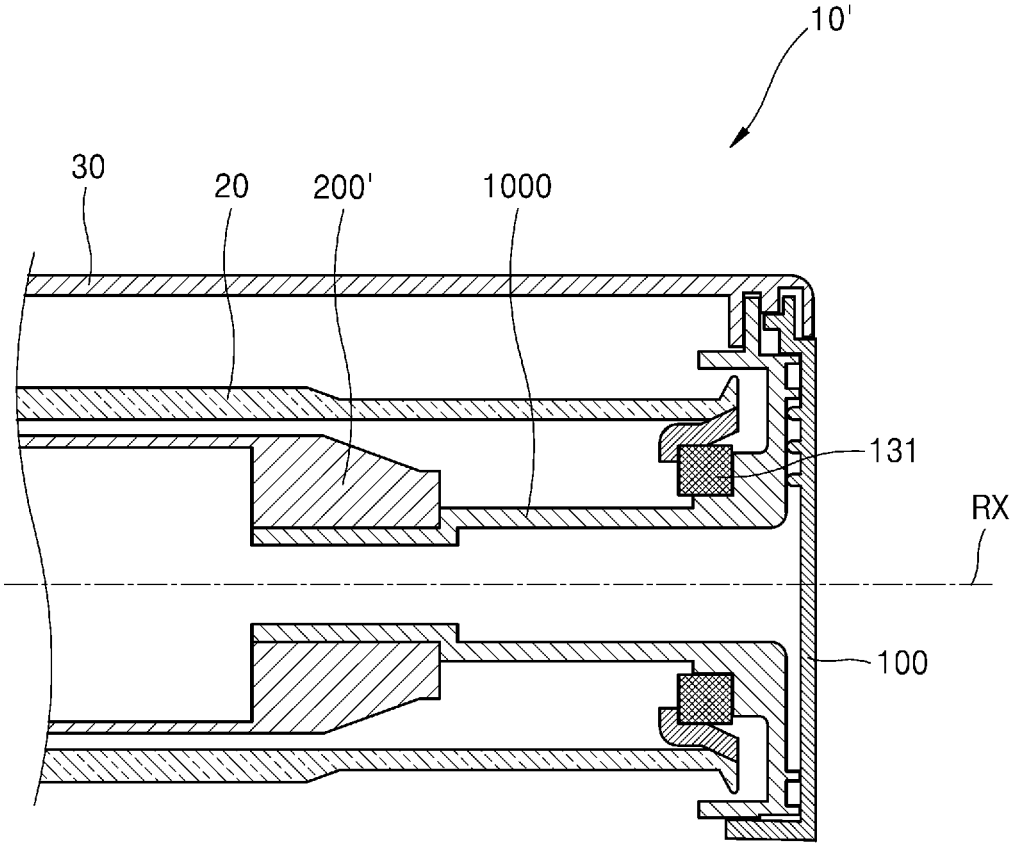
FIG. 5 is a diagram for describing a bearing and a support structure of a driving assembly in a cleaner head, according to a comparative example.

FIG. 5 is a diagram for describing the bearing 131 and a support structure of the driving assembly 40 in a cleaner head 10', according to a comparative example. Referring to FIG. 5, in the cleaner head 10' according to the comparative example, a structure may be considered where a support shaft 1000 supporting a driving housing 200' is formed long to be close to the driving motor 41 and the support shaft 1000 is inserted and fitted to the driving housing 200'. The bearing 131 supporting an end portion of the brush drum 20 may be arranged on an outer circumferential surface of the support shaft 1000.

However, in a structure where the support shaft 1000 is inserted into the driving housing 200', a space for accommodating the support shaft 1000 is required in the driving housing 200', increasing the size of the driving assembly 40. When the support shaft 1000 is displaced from the original position due to the weight of the driving motor 41 or an external force, the position of the bearing 131 mounted on the support shaft 1000 may be changed, such that the rotation axis RX of the brush drum 20 is misaligned. In case of rotation when the rotation axis RX of the brush drum 20 is misaligned, noise of the cleaner head 10' may be caused.

In the cleaner head 10 according to an embodiment of the disclosure, to prevent the axes of the driving assembly 40 and the brush drum 20 from being misaligned, an improved structure of the first support portion 100 supporting the driving assembly 40 and the end portion of the brush drum 20 will be provided.

Figure 6:
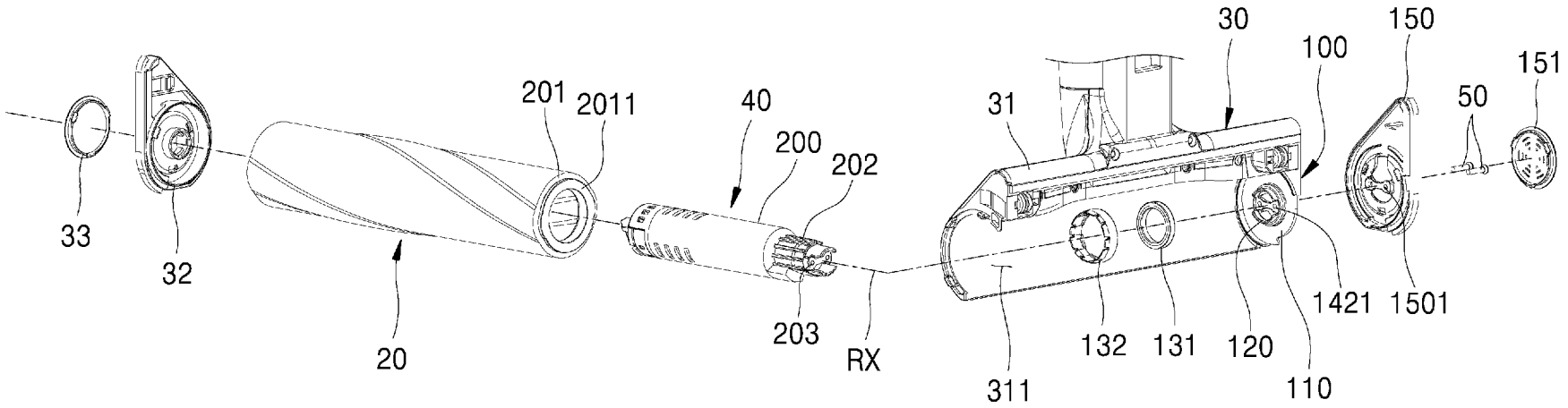
FIG. 6 is an exploded perspective view showing components mainly related to a first support portion, separated from a cleaner head, according to an embodiment of the disclosure.
Figure 7:
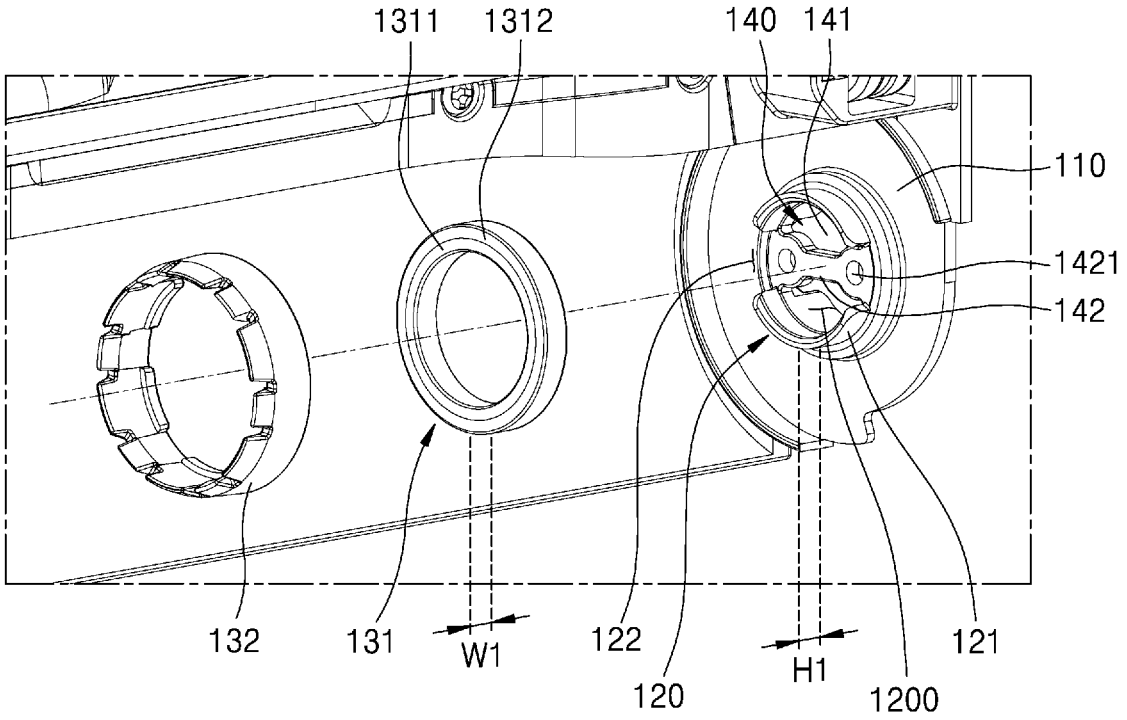
FIG. 7 is a view of the cleaner head in which a part of FIG. 6 is enlarged.
Figure 8:
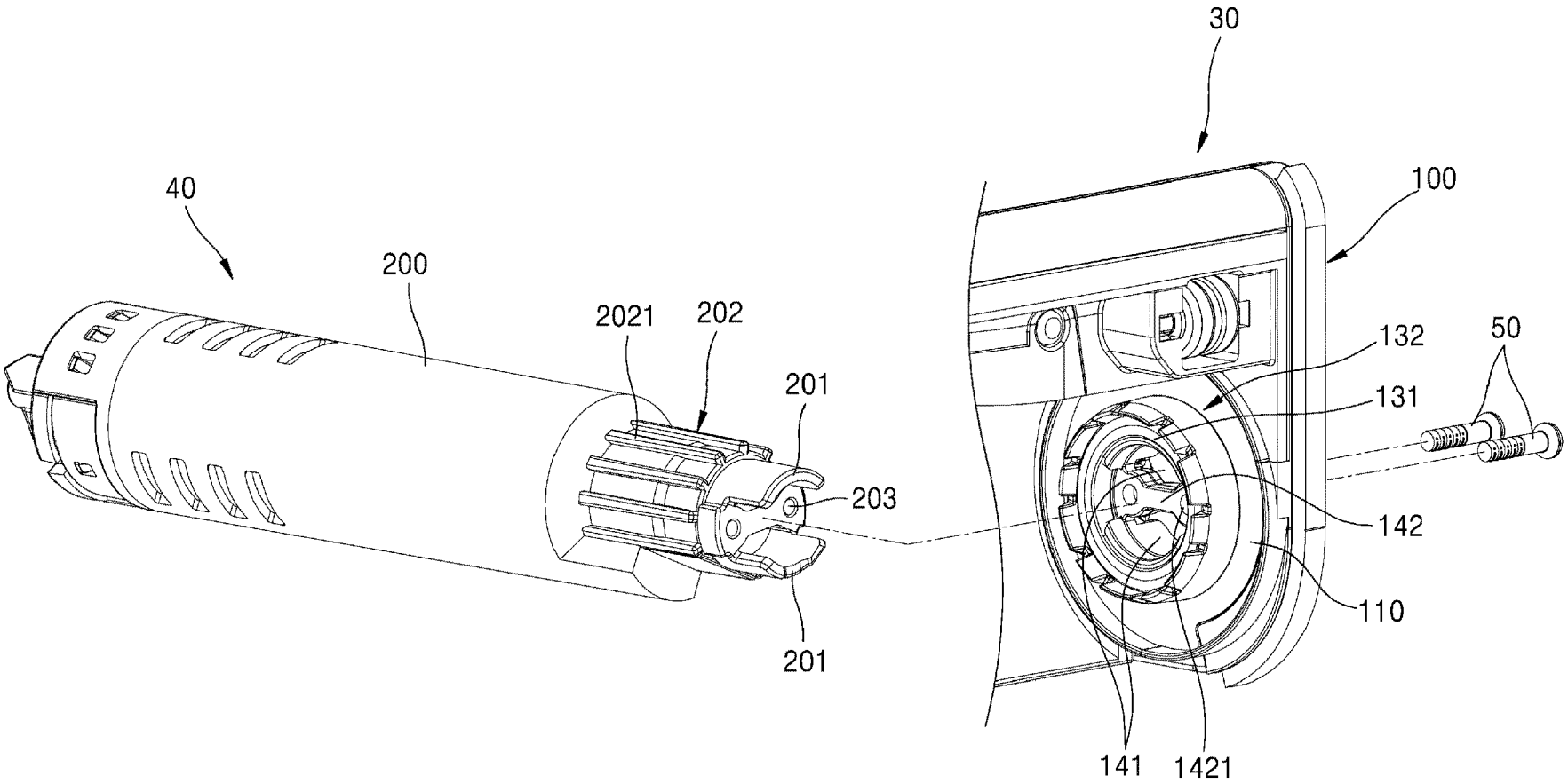
FIG. 8 is a diagram for describing a state in which a driving housing is assembled to a first support portion in a cleaner head, according to an embodiment of the disclosure.
Figure 9:
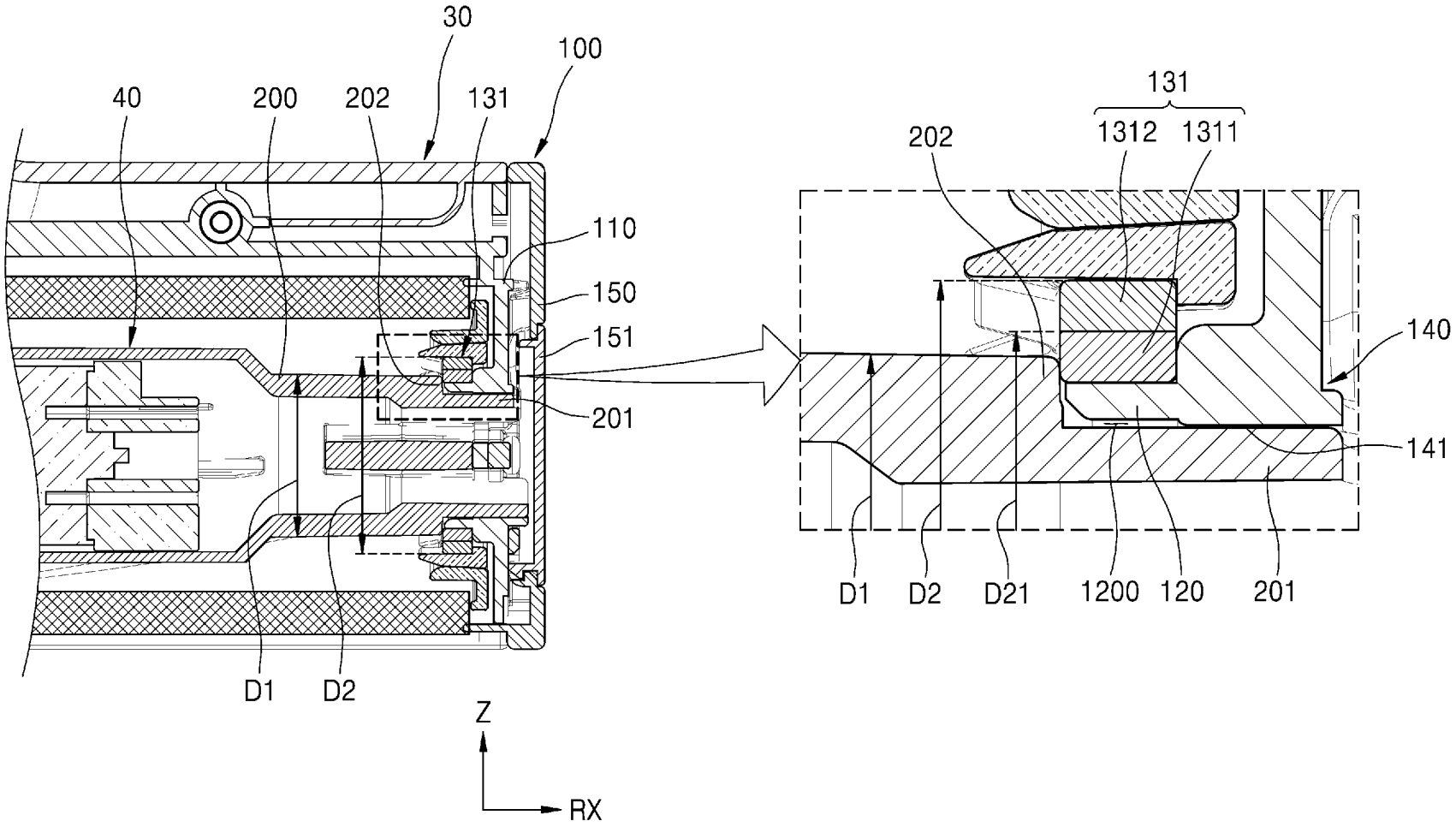
FIG. 9 is a cross-sectional view for describing a state in which a driving housing is assembled to a first support portion in a cleaner head, according to an embodiment of the disclosure.
Figure 10:
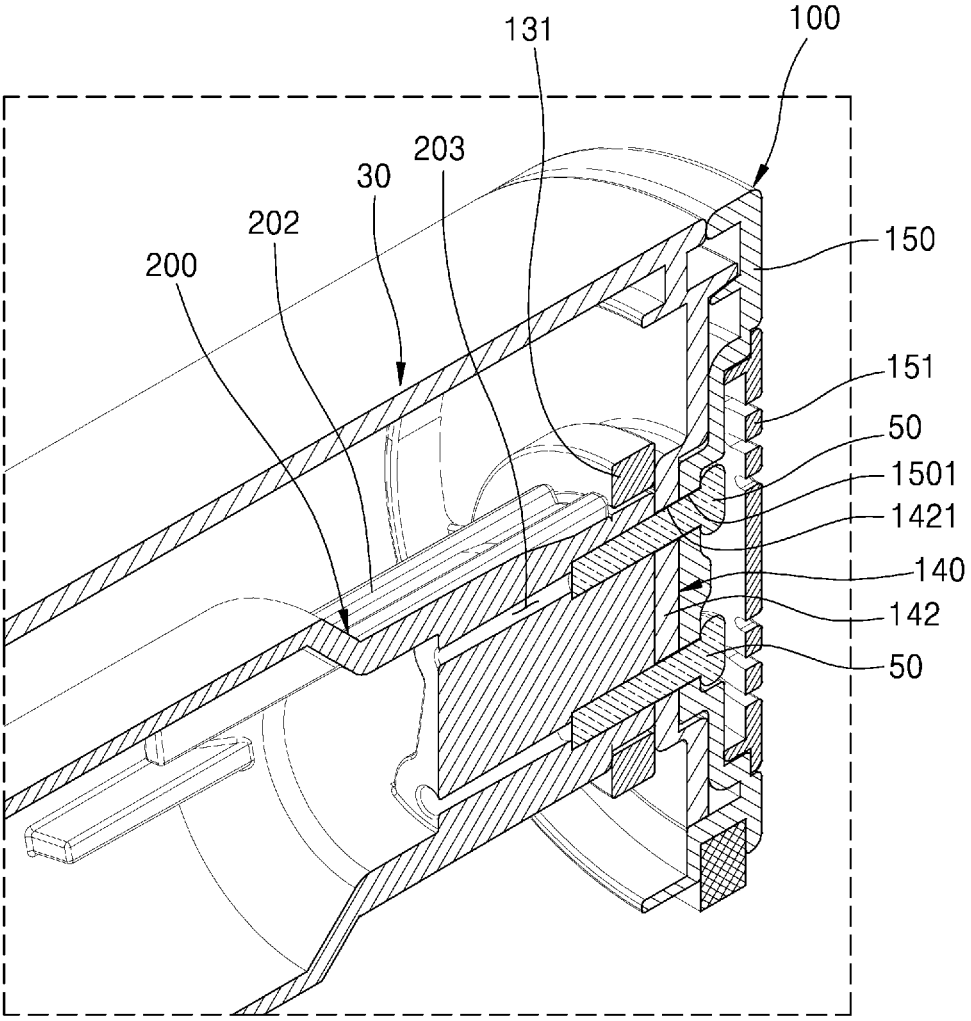
FIG. 10 is a cross-sectional perspective view showing, from another angle, a state in which a driving housing is assembled to a first support in a cleaner head, according to an embodiment of the disclosure.

FIG. 6 is an exploded perspective view showing components mainly related to the first support portion 100, separated from the cleaner head 10, according to an embodiment of the disclosure. FIG. 7 is an enlarged view of a portion of FIG. 6. FIG. 8 is a diagram for describing a state where the driving housing 200 is assembled to the first support portion 100 in the cleaner head 10, according to an embodiment of the disclosure. FIG. 9 is a diagram for describing a state where the driving housing 200 is assembled to the first support portion 100 in the cleaner head 10, according to an embodiment of the disclosure. FIG. 10 is a cross-sectional perspective view showing, from another angle, a state where the driving housing 200 is assembled to the first support portion 100 in the cleaner head 10, according to an embodiment of the disclosure.

Referring to FIGS. 6 and 7, in the cleaner head 10 according to an embodiment of the disclosure, the first support portion 100 may include a base portion 110, a bearing mounting portion 120, and a driving mounting portion 140.

The base portion 110 may form an end portion of the brush case 30. The base portion 110 may be a circular plate, and may be formed integrally with a housing portion 31 that defines a brush chamber 311.

The bearing mounting portion 120 may protrude toward the brush chamber 311 from the base portion 110 to support the bearing 131 coupled to one end portion of the brush drum 20. The bearing mounting portion 120 may provide an insertion space 1200 into which an end portion of the driving housing 200 is insertable.

A protruding height H1 of the bearing mounting portion 120 may be enough to support the bearing 131. The protruding height H1 of the bearing mounting portion 120 may be less than or equal to about 10 mm. The protruding height H1 of the bearing mounting portion 120 may be less than or equal to five times a width W1 of the bearing 131 in a direction of the rotation axis RX. The protruding height H1 of the bearing mounting portion 120 may be less than or equal to three times the width W1 of the bearing 131 in the direction of the rotation axis RX. The protruding height H1 of the bearing mounting portion 120 may be less than or equal to twice the width W1 of the bearing 131 in the direction of the rotation axis RX. The protruding height H1 of the bearing mounting portion 120 may be equal to or greater than the width W1 of the bearing 131 in the direction of the rotation axis RX to support the bearing 131.

The bearing mounting portion 120 may extend in a circumferential direction. The bearing mounting portion 120 may include, on an outer circumferential surface thereof, a bearing seating groove 121 in which the bearing 131 is seated. The bearing mounting portion 120 may include a cut portion 122 and have an open-loop structure.

The bearing 131 may be assembled and fixed in the bearing seating groove 121. The bearing 131 may be coupled to one end portion of the brush drum 20 such that the brush drum 20 rotates with respect to the bearing mounting portion 120.

The bearing 131 may include an inner ring 1311 fixed to the bearing mounting portion 120 and an outer ring 1312 rotatable with respect to the inner ring 1311. A brush support portion 132 may be assembled to an outer circumferential surface of the bearing 131.

The brush support portion 132 may be assembled to the outer ring 1312 of the bearing 131 and may be coupled to the end portion 201 of the brush drum 20. The brush support portion 132 may be fitted to the end portion 201 of the brush drum 20. For example, the brush support portion 132 may be fitted to the end portion 201 of the brush drum 20 through a mount 2011 assembled to the end portion 201 of the brush drum 20.

Referring to FIGS. 6 to 8, the driving mounting portion 140 may be arranged to be separated from the bearing mounting portion 120 and to support one end portion of the driving housing 200 inserted into the insertion space 1200. For example, the driving mounting portion 140 may include a mounting slit 141 passing through the base portion 110.

Referring to FIGS. 8 and 9, the mounting slit 141 may be separated from the bearing mounting portion 120. For example, the mounting slit 141 may be separated from the bearing mounting portion 120 in the direction of the rotation axis RX and a direction Z perpendicular to the direction of the rotation axis RX.

The driving housing 200 may include a mounting protrusion 201 that protrudes in the direction of the rotation axis RX so as to be inserted into the mounting slit 141. The mounting protrusion 201 may contact the inner circumferential surface of the mounting slit 141. The mounting protrusion 201 may be fitted to the mounting slit 141. The end portion of the driving housing 200 inserted into the insertion space 1200 contacts the mounting slit 141 of the driving mounting portion 140, but does not contact the bearing mounting portion 120. Thus, even the external force applied to the driving housing 200 is exerted to the mounting slit 141, it is possible to minimize direct transmission to the bearing mounting portion 120.

The driving housing 200 may further include a bearing contact portion 202 that contacts and is supported by a portion of the bearing 131. The bearing contact portion 202 may protrude in a radial direction, e.g., the direction Z, beyond the bearing mounting portion 120. For example, the bearing contact portion 202 may include a plurality of ribs 2021 arranged on the outer circumferential surface of the driving housing 200. In a process where the driving housing 200 is assembled to the driving mounting portion 140, the bearing contact portion 202 may contact to be supported by a portion of the bearing 131. For example, the bearing contact portion 202 may contact to be supported by a side surface of the inner ring 1311 of the bearing 131.

When the bearing contact portion 202 contacts the bearing 131, the bearing contact portion 202 may be adapted not to contact the outer ring 1312 of the bearing 131 to avoid rotation of the bearing 131. For example, an outer diameter D1 of the bearing contact portion 202 may be less than an outer diameter D2 of the bearing 131. For example, the outer diameter D1 of the bearing contact portion 202 may be less than an inner diameter D21 of the outer ring 1312 of the bearing 131.

Referring to FIGS. 6, 8, and 10, the driving mounting portion 140 and the driving housing 200 may be screw-coupled to each other. The driving mounting portion 140 may further include at least one first coupling hole 1421, and the driving housing 200 may further include a second coupling hole 203 corresponding to the first coupling hole 1421. The first coupling hole 1421 may be formed in a mounting bridge 142 arranged between the plurality of mounting slits 141. The cleaner head 10 may further include a screw member 50 coupled to the second coupling hole 203 through the first coupling hole 1421.

A deco cap 150 may be arranged on an outer side of the first support portion 100. The deco cap 150 may be assembled to the first support portion 100 and form a side appearance of the cleaner head 10. The deco cap 150 may include a third coupling hole 1501 corresponding to the first coupling hole 1421 of the first support portion 100. The screw member 50 may be coupled to the second coupling hole 203 of the driving housing 200 through the third coupling hole 1501 and the first coupling hole 1421. A cap cover 151 may be assembled to the deco cap 150. The cap cover 151 may prevent exposure of the screw member 50.

By inserting and tightening the screw member 50 into the first coupling hole 1421, the second coupling hole 203, and the third coupling hole 1501, the bearing contact portion 202 may contact a side surface of the bearing 131 and press the side surface of the bearing 131. The screw member 50 may be provided in plural, but may also be single without being limited thereto.

The driving housing 200 may be fitted to the mounting slit 141 arranged separated from the bearing mounting portion 120, and may be pressed in a direction toward the driving mounting portion 140 by the screw member 50, such that an end portion of the driving housing 200 is fixed to the first support portion 100. In a process where the end portion of the driving housing 200 is fixed, the bearing contact portion 202 of the driving housing 200 may contact to be supported by the side surface of the bearing 131. As the driving housing 200 contacts and is supported by the driving mounting portion 140 and the bearing 131 in a plurality of points, it is possible to prevent the driving motor 41 from being misaligned by the weight thereof or an external force.

As such, in the cleaner head 10 according to an embodiment of the disclosure, the bearing mounting portion 120 may be provided separated from the driving mounting portion 140 for supporting the driving assembly 40, thereby minimizing the misalignment of the driving mounting portion 140 leading to the misalignment of the bearing mounting portion 120. Moreover, the driving housing 200 of the driving assembly 40 may perform additional support through the bearing contact portion 202 together with fixing and support by the driving mounting portion 140, thereby preventing misalignment of the driving housing 200. Therefore, in the cleaner head 10 according to an embodiment of the disclosure, it is possible to reduce the misalignment of the driving assembly 40 and the bearing 131 and to implement the driving assembly 40 that is compact.

The cleaner head and the cleaner according to embodiments of the disclosure described above may prevent the axis of the driving assembly from being misaligned and provide good rotation characteristics of the brush drum.

According to an embodiment of the disclosure, a cleaner head includes a brush drum configured to rotate, a brush case providing a brush chamber that accommodates the brush drum and including a first support portion and a second support portion that are arranged in both end portions of the brush drum in a direction of a rotation axis and rotatably support the brush drum, and a driving assembly configured to transfer rotation power to the brush drum and including a driving motor arranged inside the brush drum and a driving housing supporting the driving motor, in which the first support portion includes a base portion forming one end portion of the brush case, a bearing mounting portion protruding toward the brush chamber from the base portion to support a bearing coupled to one end portion of the brush drum and providing an insertion space into which an end portion of the driving housing is insertable, and a driving mounting portion arranged to be separated from the bearing mounting portion and supporting an end portion of the driving housing inserted into the insertion space.

A protruding height of the bearing mounting portion may be less than or equal to five times a width of the bearing in the direction of the rotation axis.

The bearing mounting portion may extend in a circumferential direction and include a bearing seating groove having the bearing seated on an outer circumferential surface thereof.

The driving mounting portion may include a mounting slit passing through the base portion, and the driving housing may include a mounting protrusion that protrudes in the direction of the rotation axis to be inserted into the mounting slit and contacts an inner circumferential surface of the mounting slit.

The driving housing may further include a bearing contact portion protruding in a radial direction beyond the bearing mounting portion and contacting to be supported by a portion of the bearing.

The bearing may include an inner ring fixed in the mounting portion and an outer ring rotatable with respect to the inner ring, and the bearing contact portion may contact to be supported by a side surface of the inner ring.

The driving mounting portion may further include a first coupling hole, the driving housing may further include a second coupling hole corresponding to the first coupling hole, and the cleaner head may further include a screw member passing through the first coupling hole and coupled to the second coupling hole.

According to the screw member being coupled to the second coupling hole, the bearing contact portion may contact to be supported by a side surface of the bearing.

The cleaner head may further include a brush support portion assembled to the outer ring such that the bearing is coupled to one end portion of the brush drum, in which the one end portion of the brush drum is fitted to the brush support portion.

According to an embodiment of the disclosure, a cleaner includes a cleaner head, in which the cleaner head includes a brush drum configured to rotate, a brush case providing a brush chamber that accommodates the brush drum and provided with a first support portion and a second support portion that are arranged in both end portions of the brush drum in a direction of a rotation axis and rotatably support the brush drum, and a driving assembly configured to transfer rotation power to the brush drum and including a driving motor arranged inside the brush drum and a driving housing supporting the driving motor, and in which the first support portion includes a base portion forming an end of the brush case, a bearing mounting portion protruding toward the brush chamber from the base portion to support a bearing coupled to one end portion of the brush drum and providing an insertion space into which an end portion of the driving housing is insertable, and a driving mounting portion arranged to be separated from the bearing mounting portion and supporting an end portion of the driving housing inserted into the insertion space.

A protruding height of the bearing mounting portion may be less than or equal to five times a width of the bearing in the direction of the rotation axis.

The driving mounting portion may include a mounting slit passing through the base portion, and the driving housing may include a mounting protrusion that protrudes in the direction of the rotation axis to be inserted into the mounting slit and contacts an inner circumferential surface of the mounting slit.

The bearing may include an inner ring fixed in the mounting portion and an outer ring rotatable with respect to the inner ring, and the bearing contact portion may contact to be supported by a side surface of the inner ring.

The bearing may include an inner ring fixed in the mounting portion and an outer ring rotatable with respect to the inner ring, and the bearing contact portion may contact to be supported by a side surface of the inner ring.

The driving mounting portion may further include a first coupling hole, the driving housing may further include a second coupling hole corresponding to the first coupling hole, and the cleaner head may further include a screw member passing through the first coupling hole and coupled to the second coupling hole.

To understand the disclosure, reference numerals have been given in preferred embodiments of the disclosure shown in the drawings, and specific terms are used to describe the embodiments of the disclosure, but the disclosure is not limited by the specific terms, and the disclosure may include all the components that are normally thought by those of ordinary skill in the art.

Certain executions described here are embodiments of the disclosure, not limiting the scope of the disclosure in any way. For the brevity of the specification, the description of conventional electronic configurations, control systems, software, and other functional aspects of the systems may be omitted. Connections of lines or connection members between components shown in the drawings are illustrative of functional connections and/or physical or circuit connections, and in practice, may be represented as alternative or additional various functional connections, physical connections, or circuit connections. In addition, when there is no specific mentioning, such as "essential" or "important", it may not be a necessary component for the application of the disclosure. An expression such as "comprising", "including", etc., used herein has been used to be understood as terms of an open end of the description.

In the specification (especially, claims) of the disclosure, the use of the term "the" and similar indicators thereof may correspond to both the singular and the plural. In addition, when the range is described in the disclosure, the range includes the disclosure to which an individual value falling within the range is applied (unless stated otherwise), and is the same as the description of an individual value constituting the range in the detailed description of the disclosure. Finally, when there is no apparent description of the order of operations constituting the method according to the disclosure or a contrary description thereof, the operations may be performed in an appropriate order. However, the disclosure is not necessarily limited according to the describing order of the operations. The use of all examples or exemplary terms (for example, etc.) in the disclosure are to simply describe the disclosure in detail, and unless the range of the disclosure is not limited by the examples or the exemplary terms unless limited by the claims. In addition, it would be apparent to those of ordinary skill in the art that various modifications and changes may be easily made without departing from the scope and spirit of the disclosure.

What is claimed is:

1. A cleaner head comprising:
- a brush drum;
- a bearing coupled to one end portion of the brush drum and configured to support rotation of the brush drum;
- a driving assembly including:
  - a driving motor inside the brush drum and configured to transfer rotation power to the brush drum to rotate the brush drum along a rotation axis, and
  - a driving housing supporting the driving motor and including a mounting protrusion protruding from the driving housing along the rotation axis;
- a brush case including;
  - a first end portion along the rotation axis,
  - a second end portion along the rotation axis and opposite to the first end portion,
  - a brush chamber accommodating the brush drum,
  - a first support portion in the first end portion and including:
    - a base portion,
    - a bearing mounting portion protruding from the base portion toward the brush chamber, supporting the bearing, and
    - a driving mounting portion separated from the bearing mounting portion, including a mounting slit into which the mounting protrusion is inserted so as to support an end portion of the driving housing, and
  - a second support portion in the second end portion and configured to support rotation of the brush drum in the brush case.

2. The cleaner head of claim 1, wherein a protruding height of the bearing mounting portion is less than or equal to five times a width of the bearing along the rotation axis.

3. The cleaner head of claim 1, wherein the bearing mounting portion extends along a circumferential direction and includes a bearing seating groove having an outer circumferential surface on which the bearing is seated.

4. The cleaner head of claim 1, wherein
- the mounting protrusion contacts an inner circumferential surface of the mounting slit.

5. The cleaner head of claim 4, wherein the driving housing further includes a bearing contact portion protruding along a radial direction of the driving housing beyond the bearing mounting portion and that is supported by a portion of the bearing.

6. The cleaner head of claim 5, wherein
- the bearing includes:
  - an inner ring fixed in the bearing mounting portion, and
  - an outer ring rotatable with respect to the inner ring, and
- the bearing contact portion is supported by a side surface of the inner ring.

7. The cleaner head of claim 5, wherein
- the driving mounting portion further includes a first coupling hole,
- the driving housing further includes a second coupling hole corresponding to the first coupling hole, and
- the cleaner head further includes a screw member that passes through the first coupling hole and is coupled to the second coupling hole.

8. The cleaner head of claim 7, wherein
- the screw member is coupled to the second coupling hole, and
- the bearing contact portion is supported by a side surface of the bearing.

9. The cleaner head of claim 6, further comprising: a brush support portion coupled to the outer ring so that the bearing is coupled to the one end portion of the brush drum.

10. A cleaner comprising:
- a cleaner head including:
  - a brush drum;

a bearing coupled to one end portion of the brush drum and configured to support rotation of the brush drum;

a driving assembly including:

a driving motor arranged inside the brush drum and configured to transfer rotation power to the brush drum to rotate the brush drum along a rotation axis, and a driving housing supporting the driving motor and including a mounting protrusion protruding from the driving housing along the rotation axis;

a brush case including:

a first end portion along the rotation axis, a second end portion along the rotation axis and opposite to the first end portion, a brush chamber accommodating the brush drum, a first support portion in the first end portion and including:

a base portion, a bearing mounting portion protruding from the base portion toward the brush chamber, supporting the bearing, and a driving mounting portion separated from the bearing mounting portion, including a mounting slit into which the mounting protrusion is inserted so as to support an end portion of the driving housing, and a second support portion in the second end portion and configured to support rotation of the brush drum in the brush case.

11. The cleaner of claim 10, wherein a protruding height of the bearing mounting portion is less than or equal to five times a width of the bearing along the rotation axis.

12. The cleaner of claim 10, wherein the mounting protrusion contacts an inner circumferential surface of the mounting slit.

13. The cleaner of claim 12, wherein the driving housing further includes a bearing contact portion protruding along a radial direction of the driving housing beyond the bearing mounting portion and that is supported by a portion of the bearing.

14. The cleaner of claim 13, wherein the bearing includes:

an inner ring fixed in the bearing mounting portion, and an outer ring rotatable with respect to the inner ring, and the bearing contact portion contacts to be supported by a side surface of the inner ring.

15. The cleaner of claim 13, wherein the driving mounting portion further includes a first coupling hole, the driving housing further includes a second coupling hole corresponding to the first coupling hole, and the cleaner head further includes a screw member that passes through the first coupling hole and is coupled to the second coupling hole.

16. The cleaner head of claim 1, wherein the mounting slit is formed through the base portion.

17. The cleaner of claim 10, wherein the mounting slit is formed through the base portion.

* * * * *